United States Patent [19]

Stancil

[11] Patent Number: 4,735,338

[45] Date of Patent: Apr. 5, 1988

[54] REMOVABLE FASTENER FOR POT LID

[76] Inventor: Danny R. Stancil, 5220 Troutman La., Raleigh, N.C. 27612

[21] Appl. No.: 67,708

[22] Filed: Jun. 29, 1987

[51] Int. Cl.[4] ..... B65D 45/16

[52] U.S. Cl. ..... 220/324; 215/290

[58] Field of Search ..... 220/315, 318, 324; 215/281, 282, 290

[56] References Cited

U.S. PATENT DOCUMENTS

| | | | |
|---|---|---|---|
| 276,276 | 4/1883 | Peirce | 215/290 |
| 292,110 | 1/1884 | Frost | 215/290 |
| 372,212 | 10/1887 | Faatz et al. | 215/290 |
| 662,241 | 11/1900 | Mills | 215/282 |
| 739,628 | 9/1903 | Wilkins | 215/290 |
| 1,290,378 | 1/1919 | Silley . | |
| 1,390,832 | 9/1921 | Spelling | 215/281 |
| 2,637,459 | 5/1953 | Jordan . | |
| 3,746,205 | 7/1973 | Helguera | 220/324 |

*Primary Examiner*—George T. Hall

*Attorney, Agent, or Firm*—Richard E. Jenkins

[57] ABSTRACT

A removable fastener particularly adapted for securing the lid to a pot to prevent spillage of the contents thereof. The fastener includes a first and second clamp member each having a first cross member adapted to engage the pot and a second cross member adapted to engage the lid thereof and an elastomeric strip secured at each end thereof to a respective one of the clamp members.

10 Claims, 2 Drawing Sheets

REMOVABLE FASTENER FOR POT LID

DESCRIPTION

1. Technical Field

The present invention relates to a removable fastener for securing the lid to a cooking pot or baking dish in order to facilitate movement of the pot or baking dish without spilling the contents thereof.

2. Background Art

It is known in the art of container top securement to provide for spring fasteners such as taught by Peirce in U.S. Pat. Nos. 276,276, Faatz, et al. 372,212, Mills 662,241 and Spelling 1,390,832. Moreover, U.S. Pat. No. 292,110 to Frost discloses a crock cover for securing the lid of a crock with a staple assembly located on opposite sides of the crock cover and connected by a curved metallic wire handle extending therebetween. However, a simple and easy to use removable fastener for securing the lid or top to a pot or baking dish has not yet been developed. Thus, the search for a better fastener for pot lids has continued.

DISCLOSURE OF THE INVENTION

In accordance with the present invention, applicant provides a removable fastener for securing a lid or top to a pot which is designed specifically for ease of use and comprises first and second clamp members each having a first cross member to engage the pot and a second cross member to engage the lid of the pot. An elastomeric strip is secured at each end to an upstanding portion of a respective one of the first and second clamp members so that when the clamp members are positioned on diametrically opposing sides of a pot, the first cross members will be urged against the pot and the second cross members will be urged against the lid so as to secure the lid to the pot in such a fashion that the contents thereof will not be spilled while the pot is being carried or otherwise transported from one place to another. As can be appreciated, the removable fastener is adapted to be easily attached to a pot and lid as needed and then may be easily detached therefrom and stored for future use.

It is therefore the object of this invention to provide a simple and easy to use removable fastener for securing the lid to a pot so that the contents therein will not be spilled during transportation of the pot.

Another object of the present invention is to provide an inexpensive and easy to use removable fastener for securing the lid to a casserole or other type of baking dish to prevent spillage of the contents when the baking dish is carried or otherwise transported.

BRIEF DESCRIPTION OF THE DRAWINGS

Some of the objects of the invention having been stated, other objects will become evident as the description proceeds, when taken in connection with the accompanying drawings, in which.

BEST MODE FOR CARRYING OUT THE INVENTION

Figure 1:
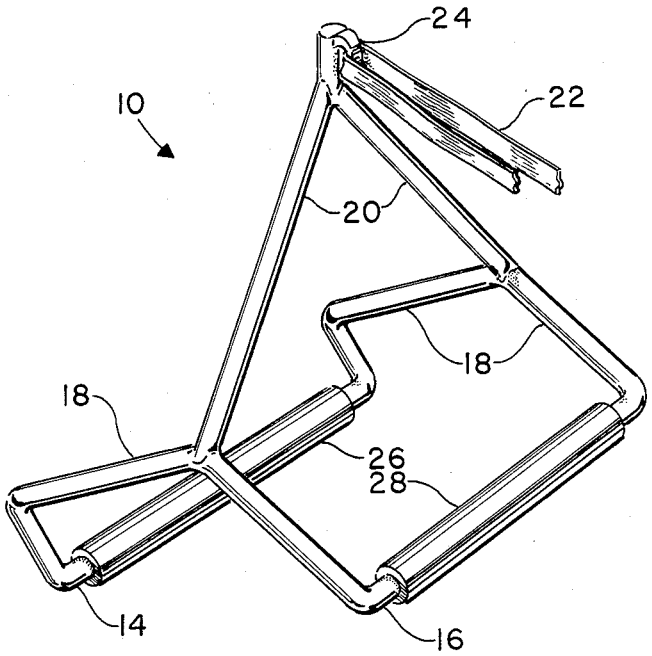
FIG. 1 is a perspective view of the first clamp member of the removable fastener of the invention; the second clamp member being substantially identical thereto.
Figure 2:
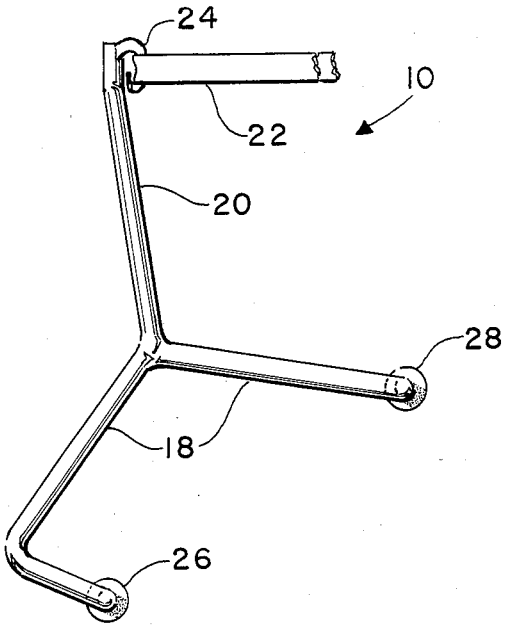
FIG. 2 is a side elevation view of the first clamp member of the removable fastener of the present invention.
Figure 3:
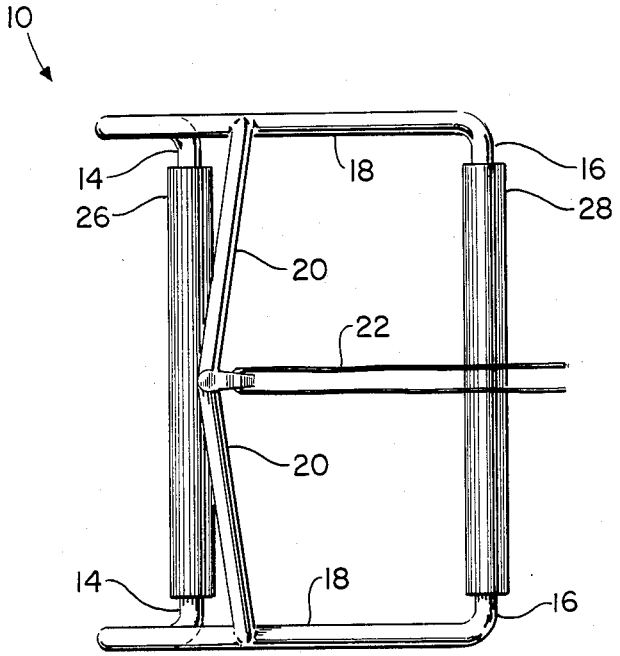
FIG. 3 is a top plan view of the first clamp member of the removable fastener of the present invention.

Referring to the drawings, a removable fastener for securing a lid to a pot and constructed in accordance with the present invention is fully shown in FIGS. 1–4. With particular reference now to FIGS. 1–3, the construction of first clamp member 10 of the removable fastener can be more fully appreciated. First clamp member 10 comprises first cross member 14 and second cross member 16. Cross members 14 and 16 are connected by frame 18 and upstanding element 20. An elastomeric strip such as rubber band 22 is connected at one end to hook 24 of upstanding element 20 of first clamp member 10 and at the other end to the hook of the upstanding element of the second clamp member (see FIG. 4).

Although a matter of design choice, applicant presently contemplates that rubber band 22 will be secured to upstanding element 20 by means of the hook depicted in the drawings although other securement means are clearly possible. First cross member 14 and second cross member 16 may be provided with rubber sleeves 26 and 28, respectively, thereover in order to cushion the contact between the cross members and the pot or baking dish to which clamp member 10 is secured. First clamp member 10 may be constructed of any material of suitable strength such as steel or hard plastic.

Figure 4:
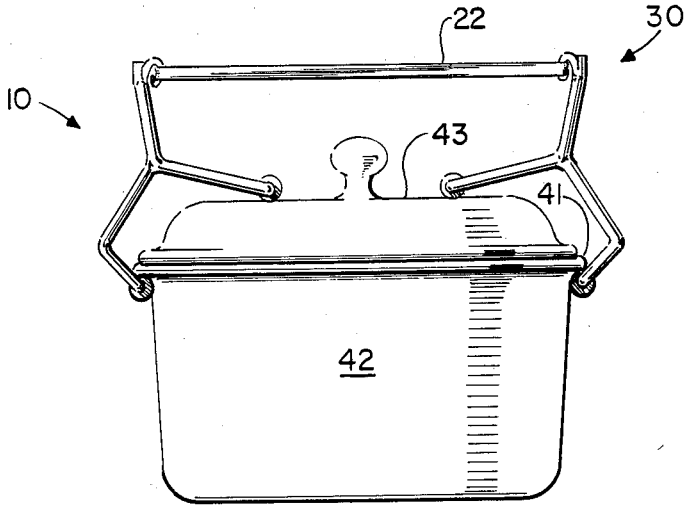
FIG. 4 is a pictorial view of the removable fastener of the present invention attached to a pot and lid so as to secure the lid to the pot.

With reference now to FIG. 4, it can be appreciated that second clamp member 30 is constructed identically to first clamp member 10. First clamp member 10 and second clamp member 30 connected together by rubber band 22 comprises the removable fastener of the present invention.

In operation, use of the removable fastener to secure a lid to a pot or a top to a baking dish is easy and expedient. For ease of explanation, the method of its use will be described in terms of first securing first clamp member 10 to the pot and lid followed by the securement of second clamp member 30 thereto although the sequence can be reversed. First clamp member 10 is positioned with first cross member 14 beneath the lip 41 of pot 42 and second cross member 16 is then pushed downwardly against lid 43 of pot 42. Next, second clamp member 30 is pulled away from first clamp member 10 against the urging of rubber band 22 and the same attachment steps repeated so as to secure second clamp member 30 to pot 42 and lid 43. Once secured in this fashion, the resilient force exerted by rubber band 22 on first clamp member 10 and second clamp member 30 applies a leveraged force through the corresponding upstanding elements to the upper cross member of each clamp member in order to maintain lid 43 tightly closed. In this fashion, a pot substantially filled with food can be carried by hand or placed in a car in order to be transported from one place to another without concern that spillage may occur.

The removable fastener may also be used on a baking dish, casserole dish or other container of the type having two diametrically opposing handles adjacent the top thereof since first and second clamp members 10 and 30 of the removable fastener can each be secured to a respective one of the pair of handles. Thus, the removable fastener of the present invention may be used both with a cooking pot and lid of the type wherein the pot has a lip around the circumference thereof and with a pot, cooking dish or the like having two opposing handles adjacent the top of the dish.

In order to remove the removable fastener, first clamp member 10 and second clamp member 30 are grasped and pivoted outwardly away from each other in order to be disengaged from the pot or baking dish to which they have been secured. The removable fastener may then be easily stored for future use.

It will thus be seen that there has been described above a simple and inexpensive removable fastener for securing the lid to a pot or baking dish in order to facilitate transportation thereof without risk of spilling the contents of the container.

It will be understood that various details of the invention may be changed without departing from the scope of the invention. Furthermore, the foregoing description is for the purpose of illustration only, and not for the purpose of limitation—the invention being defined by the claims.

What is claimed is:

1. A removable fastener for securing a lid to a pot comprising:

a first clamp member having a first cross member adapted to engage the pot and a second cross member adapted to engage the lid;

a second clamp member having a first cross member adapted to engage the pot and a second cross member adapted to engage the lid; and elongate resilient means secured at each end thereof to a respective one of said first and second clamp members and adapted so that when said first and second clamp members are positioned on opposing sides of the pot the second cross members of said clamp members are urged against the lid and the first cross members of said clamp members are urged against the pot so as to secure the lid to the pot.

2. A removable fastener for securing a lid to a pot according to claim 1 wherein said first and second clamp members each comprises an upstanding support element extending above the first and second cross members and adapted to be engaged by said resilient means.

3. A removable fastener for securing a lid to a pot according to claim 1 wherein the first and second cross members of each of said first and second clamp members comprises a resilient cushion surface.

4. A removable fastener for securing a lid to a pot according to claim 1 wherein said first and second clamp members are metal.

5. A removable fastener for securing a lid to a pot according to claim 1 wherein said resilient means is an elastomeric strip.

6. A removable fastener for securing a lid to a pot according to claim 5 wherein said elastomeric strip is a rubber band.

7. A removable fastener for securing a lid to a pot comprising:

a first clamp member having a first cross member adapted to engage the pot, a second cross member adapted to engage the lid, and an upstanding element extending above the first and second cross members;

a second clamp member having a first cross member adapted to engage the pot, a second cross member adapted to engage the lid, and an upstanding element extending above the first and second cross members; and an elastomeric strip secured at each end thereof to a respective one of said upstanding elements of said first and second clamp members and adapted so that when said first and second clamp members are positioned on opposing sides of the pot the second cross members of said clamp members are urged against the lid and the first cross members of said clamp members are urged against the pot so as to secure the lid to the pot.

8. A removable fastener for securing a lid to a pot according to claim 7 wherein the first and second cross members of each of said first and second clamp members comprises a resilient cushion surface.

9. A removable fastener for securing a lid to a pot according to claim 7 wherein said first and second clamp members are metal.

10. A removable fastener for securing a lid to a pot according to claim 7 wherein said elastomeric strip is a rubber band.

* * * * *